US005197732A

United States Patent [19]

Lanctot

[11] Patent Number: 5,197,732

[45] Date of Patent: Mar. 30, 1993

[54] TENNIS RACKET

[76] Inventor: Paul A. Lanctot, 520 Sand Hill Rd., Scotts Valley, Calif. 95066

[21] Appl. No.: 776,613

[22] Filed: Oct. 15, 1991

[51] Int. Cl.[5] ..... A63B 49/08

[52] U.S. Cl. ..... 273/735

[58] Field of Search ..... 273/73 R, 73 C, 73 J, 273/75, 73 D, 81 R, 81 H, DIG. 29

[56] References Cited

U.S. PATENT DOCUMENTS

| | | | |
|---|---|---|---|
| 879,477 | 2/1908 | Krüger | 273/72 R |
| 3,075,768 | 1/1963 | Karns | 273/81 A |
| 4,105,205 | 8/1978 | Theodores et al. | 273/73 J |
| 4,182,512 | 6/1980 | Kuebler | 273/73 C |
| 4,330,125 | 5/1982 | Sassler | 273/73 C |
| 4,674,746 | 6/1987 | Benoit | 273/78 R X |
| 4,927,143 | 5/1990 | Hillock | 273/73 D |
| 5,046,732 | 9/1991 | Chen | 273/73 J |

FOREIGN PATENT DOCUMENTS

| | | | |
|---|---|---|---|
| 2106800 | 9/1971 | Fed. Rep. of Germany | 273/73 J |
| 3706554 | 9/1988 | Fed. Rep. of Germany | 273/73 J |
| 3931010 | 4/1991 | Fed. Rep. of Germany | 273/73 J |
| 2567407 | 1/1986 | France | 273/73 J |
| 498430 | 2/1939 | United Kingdom | 273/73 J |
| 2225538 | 6/1990 | United Kingdom | 273/73 J |

*Primary Examiner*—William H. Grieb
*Assistant Examiner*—William E. Stoll
*Attorney, Agent, or Firm*—Jeffrey A. Hall

[57] ABSTRACT

A tennis racket (10) made of a rigid material and having a striking surface (12), a shaft portion (35) and a handle portion (13). A tubular member (14) is positioned in the interior of the racket at substantially the handle portion (13) and has a first end (24) and a second end (25), said first end (24) having an opening (28) therein which is removably sealed with a plug (17). A hollow spine member (16) is secured within said tubular member (14) and is preferably attached to said plug (17) and to said second end (25) of the tube member (14). A slurry (15) composed of a plurality of particles (26) and a fluid (27) is disposed within said tubular member (14). The tubular member (14) may be secured within said racket by adhesives (30) or by mechanical fastening apparatus.

16 Claims, 2 Drawing Sheets

TENNIS RACKET

DESCRIPTION

Technical Field

This invention relates to tennis rackets, particularly to tennis rackets having means to dampen and isolate shock components and vibration generated as a result of the impact when the racket strikes a ball.

Background Art

Tennis rackets, ball bats, paddles and clubs are all commonly used in various sports where the object is to strike a moving or stationary ball in order to propel it some distance. These devices have certain problems in common as well as common objectives. A primary problem is the generation of a shock as a result of the impact of the ball with the racket, or bat, or club, etc.

In a tennis racket the shock generated is most severe when the ball impacts a point other than the optimum striking point or "sweet spot" on the tennis racket. The "sweet spot" is the point where the most impact energy will be delivered to the ball and the bat rebounds straight back and opposite to the ball's line of flight, and without any torquing, end for end, as rotation is developed. When this point is missed, some of the impact energy is delivered to the racket, off center, causing the bat to racket, end for end, which results in both uncomfortable and injurious levels of shock being transmitted through the racket handle to the athlete. This is especially true with contemporary tennis rackets made of various metals, graphite, composites, and the like. At best, this painful shock can rob the athlete of confidence and at worst, it can cause serious injury.

Heretofore a wide variety of striking implements have been proposed and developed which have attempted to dampen such shock and their consequences.

One such implement, a ball bat, is disclosed in U.S. Pat. No. 4,951,948 issued to Peng where a cylindrical handle and main body are connected together and held by a retaining collar and an elastic ring. An elastic connector is provided axially attached to an end piece. Such shock absorbing bat did not provide for any relief from end torsional shock which is a primary factor for discomfort and injury, nor did such bat provide relief from the backwards reaction shock without diminution of the forward striking force which is directly and principally involved in propelling the ball.

Another implement, a tennis racket, disclosed in German Patent No. 2,106,800 to Schnell et al. attempts to dampen vibrations by imposing a layer of shock absorbing material between the shaft and the handle grip. Such racket provided only minimal relief from the shock component responsible for discomfort and injury, and little, if any, dampening effect on vibrations.

Another genre of bat is disclosed in U.S. Pat. No. 4,898,386 issued to Anderson, where a training bat consisted of a hollow cylindrical bat having a disk positioned in the interior of the bat near its center. A plate was also positioned in the interior of the bat and an object was slideably positioned in the interior of the bat and was moveable between the disk and the plate. A hollow chamber having a knob is positioned at the handle end of the bat. Such bat had limited applications as a training device but was not useful in actual sport, nor did it provide adequate shock dampening functions.

Still another type of bat is disclosed in U.S. Pat. No. 3,955,816 issued to Bratt, where a warm-up bat having a hollow chamber with granular weight material distributed therein to result in a practice ball bat with a distributed weight or bat-like feel. The handle section of such bat telescoped into one end of the tubular section filled with an aggregate of flowable material, such as sand. Such bat was not useable in actual sport as it had a deadening effect on the ball, and provided little, if any relief from the shock component responsible for discomfort and injury.

It would be highly desirable therefore to provide a means and method to specifically reduce the destructive shock and vibration generated by a tennis racket after striking a ball while leaving the ball propulsion function of the racket essentially unchanged.

DISCLOSURE OF INVENTION

In accordance with the present invention, a tennis racket is provided comprising an elongated body with a webbed or striking surface, a shaft portion, and a handle portion. A tubular member is affixed within said handle portion of said tennis racket. The tubular member has a first end and a second end, said first end having an opening therein which is preferably sealed with a removeable plug, said second end is preferably closed. A plurality of particles are interiorly disposed within said tubular member and surrounded by a fluid which is also interiorly situated within said tubular member. An elongated spine member is secured within said tubular member and is preferably centrally affixed to the center of the closed end of the tubular member.

The tubular member is preferably cylindrical is shape and may be composed of plastic, metal, rubber, urethane or the like.

The spine member is preferably composed of a soft compliant material which may be a fabric, plastic, rubber, urethane, or the like, so as to readily transfer shock to said particles and said fluid.

The particles may be of any shape e.g. granular, flakes, particulate, etc., and may be composed of a metal, plastic, composite, or the like. The particles are combined in the tubular member with a viscous fluid, such as silicon carbide, oil, or other fluid, and dampen shock components generated when the racket strikes a ball.

The present invention provides a tennis racket and a method of modifying existing tennis rackets by use of the above so as to dampen and isolate both the torquing and lengthwise shocks generated by inaccurate hits while having essentially no effect on the third shock component which is perpendicular to the long axis of the racket, and generally concentrated by weight distribution in the impact section of the racket and parallel to the line of flight of the ball. Such third shock component, which is substantially unaffected in the instant invention, is primarily a direct consequence of the acceleration of the struck ball and cannot be attenuated without causing a proportional negative effect on the flight of the ball.

In tennis an accurate hit occurs when the racket to ball contact point is directly on what is called, in the sport, "the sweet spot". An engineering term for this point is the radius of gyration. The radius of gyration is the point on a swinging racket which has the average moment of inertia for all components involved in the swinging of the racket. This not only includes the racket, but also a portion of the inertia of the athlete's arms and torso, limited by the rigidity of the athlete's grip. The rotational axis of this moment of inertia is typically through the center of the athlete's body. The precise location of this point is defined by the equation:

$$I/M=K\wedge 2$$

Where:

I is the moment of inertia.

M is the mass.

K is the radius of gyration from the axis of rotation.

The radius of gyration is therefore dependent not only on the racket, but also on the way the racket is swung. This virtually assures that shock generated by a hit not on this point or "sweet spot" will be a routine occurrence.

The present invention, by providing a racket having a tubular member having an elongated spine extending therethrough, and having a slurry of particles and fluid therein, said tubular member being securely situated in the handle of the racket, reacts specifically to high amplitude shocks delivered at the handle of the racket and to any shock acting perpendicular to the handle. This device does not adversely affect the flight of the ball as it specifically attenuates the shock which would normally be painfully absorbed by the athlete's hands, wrists and elbows. The device may be retro-fitted onto existing rackets or may be simply manufactured as a new racket.

Other advantages and a fuller understanding of the invention will be had by referring to the following description and claims of a preferred embodiment thereof taken in conjunction with the accompanying drawings wherein like reference numerals refer to similar parts throughout the several views.

BRIEF DESCRIPTION OF DRAWINGS

The details of my invention will be described in connection with the accompanying drawings, in which.

BEST MODE FOR CARRYING OUT THE INVENTION

Although specific terms are used in the following description for the sake of clarity, these terms are intended only to refer to the particular structure of the invention elected for illustration and are not intended to define or limit the scope of the invention.

Figure 1:
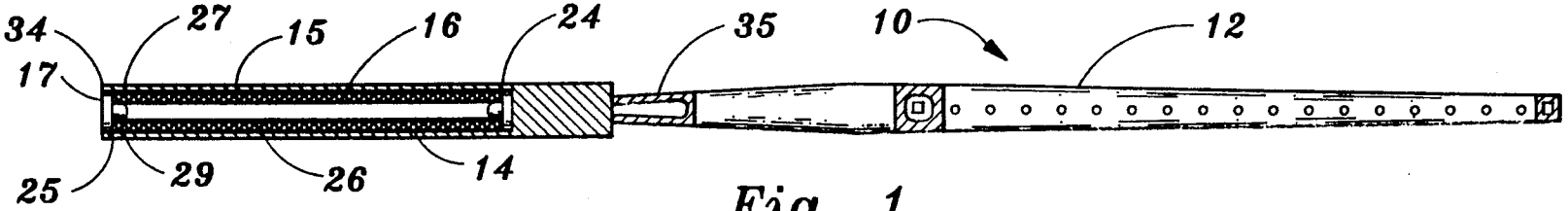
FIG. 1 is a side cross-sectional view of a tennis racket constructed in accordance with the teachings of the present invention.

FIG. 1 shows a tennis racket according to the preferred embodiment of the invention. The racket 10 comprises an elongated body with a webbed or striking surface 12, a shaft portion 35, and a handle 13. A tubular member 14 which is preferably cylindrical in shape and having a first end 24 having an opening 36, and a second end 25 which is preferably closed by seal 34, and is inserted into said handle portion 13 of racket 10. Alternatively, said tubular member 14 may be inserted into said shaft portion 35 of racket 10. Tubular member 14 is preferably rigidly secured in handle 13 by adhesives 30, but may be otherwise. An elongated spine member 16 is secured within tubular member 14. Spine member 16 is preferably centrally secured to said second end 25 of tubular member 14 by adhesives 30 and a compression nipple 29 and centrally to a plug 17 which is used to seal opening 36 of tubular member 14.

Figure 2:
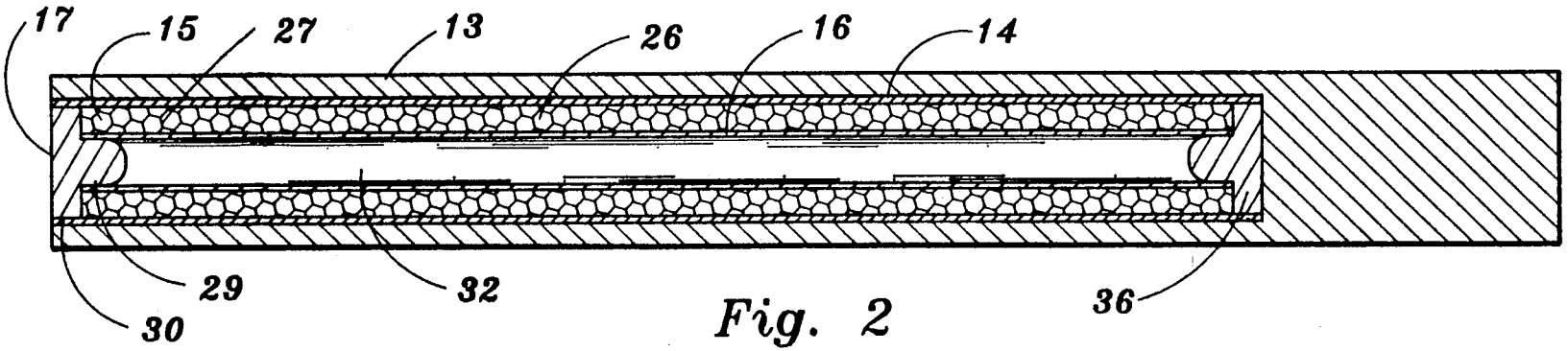
FIG. 2 is an enlarged partial, cross-sectional view corresponding to the handle area of such tennis racket, according to the invention.

Referring to FIG. 2 spine 16 is preferably affixed to plug 17 by compression nipple 29 and adhesives 30. Spine 16 is, in the preferred embodiment, hollow, having space 32 therein. Spine 16 may be composed of rubber, plastic, or any compliant material, but is preferably composed of silicone rubber.

Tubular member 14 is filled with a slurry 15 composed of a plurality of particles 26 combined with a fluid 27. The plurality of particles 26 may be composed of metal, plastics, composites, or the like, or a combination of such materials, with lead shot being a preferred particle type. The fluid is preferably viscous such as oil, or such fluid may contain material such as flaked silicon carbide, but any flowable liquid may be used. As an alternative embodiment, particles 26 and/or spine 16 may be eliminated from tube 14, however, this results in some lessening of the dampening and noise reducing effect of the present invention.

Figure 4:
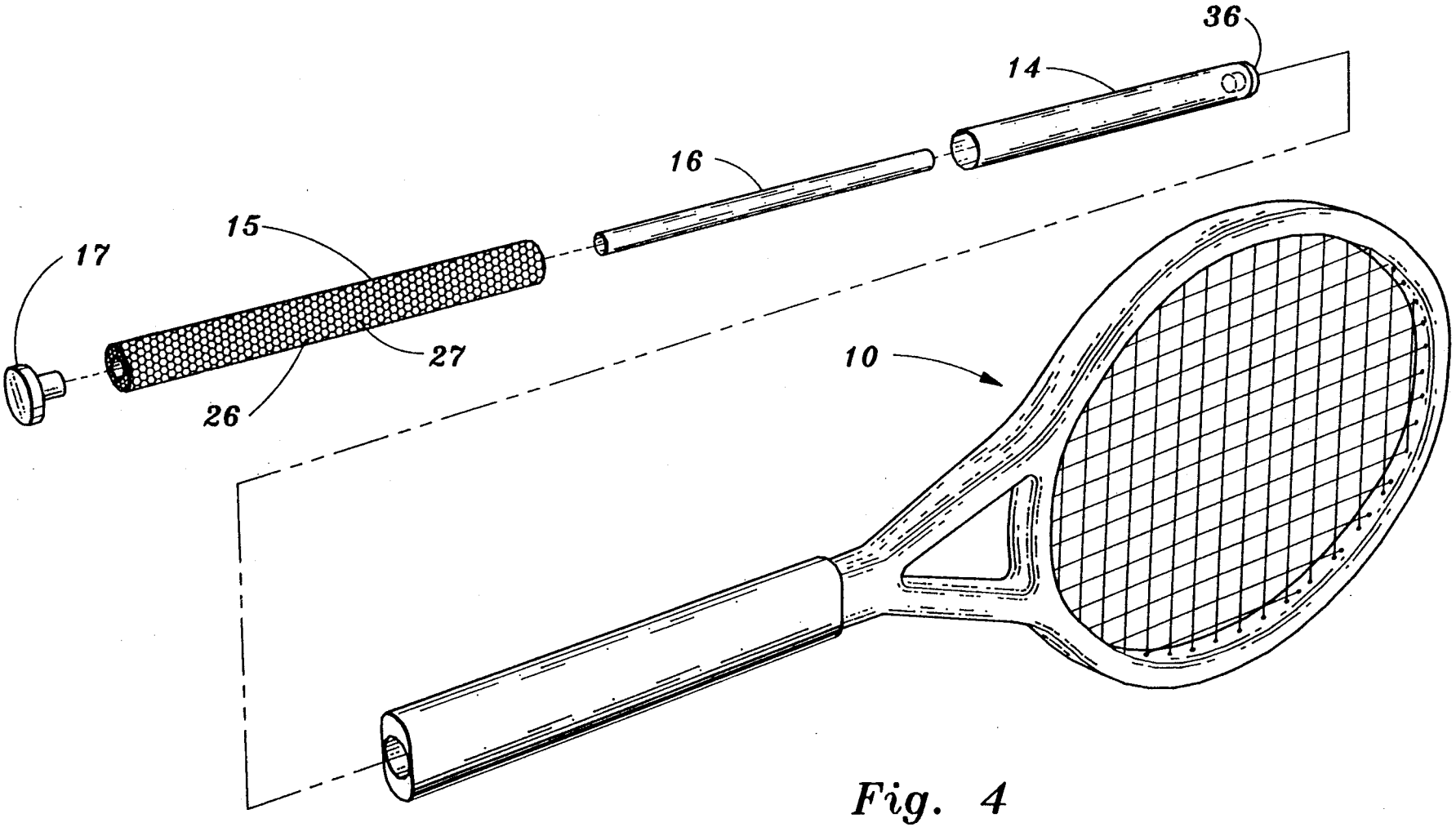
FIG. 4 is a front perspective view of such tennis racket showing the plug, tubular member and spine, partially removed from said racket.

Referring now to FIG. 4, tubular member 14 is shown partially removed from racket 10 and has plug 17 detached to better illustrate tubular member 14, slurry 15, spine 16, and plug 17. As FIG. 4 illustrates, the tubular member 14, slurry 15, spine 16, and plug 17 may be easily retro-fitted onto existing rackets or manufactured as part of a new type of racket.

Figure 3:
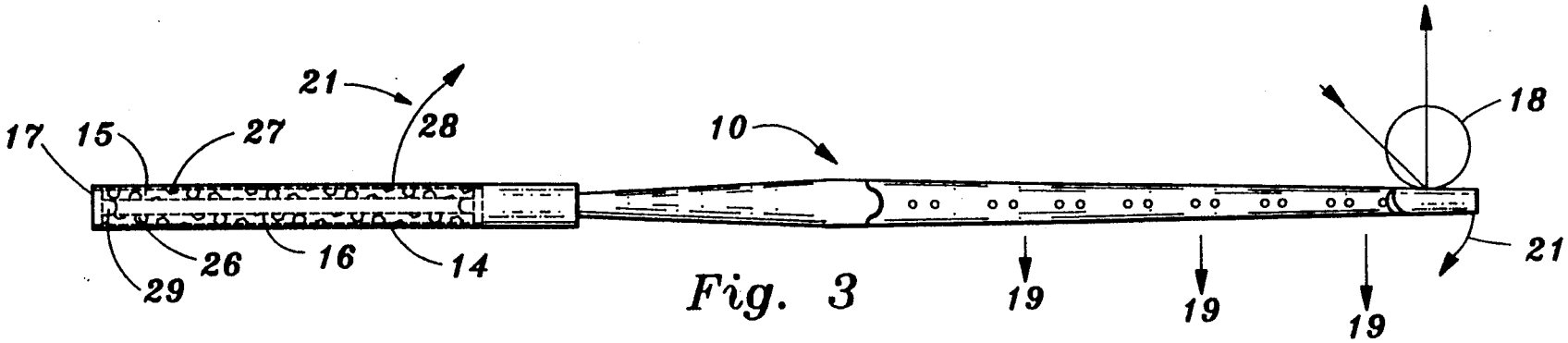
FIG. 3 is a pictorial representation of the forces and balance points associated with a ball striking such tennis racket, according to the invention.

In operation and use, racket 10 is very efficient at dampening shocks produced by accurate as well as inaccurate hits, and for enhancing a wide variety of other striking functions. It is believed that such advantages are achieved as herein described, however, no limitations on the scope or breadth of the present invention should be implied therefrom. FIG. 3 illustrates in schematic fashion, an inaccurate impact of racket 10 with a ball 18 held by person 33, which results in a reaction composed of at least three distinct shock components, shock 19 that is essentially parallel to the ball flight and distributed equally along the racket, shock 20 that is parallel to the racket axis, and shock 21 illustrating the torsional or end for end shock component of such inaccurate impact. In general terms, shock 11 causes the racket to rotate rapidly about the racket's center of mass 22 and as the distance from the location of shock 21 to the center of mass 22 may be large in proportion to the distance from handle 13 to center of mass 22, the shock delivered to the handle 13 may be very large.

FIG. 3 further illustrates that shock 21 causes handle 13 to rapidly accelerate in a path essentially at a right angle to the long axis of racket 10. When this occurs, the plurality of particles 26 in slurry 15 move about within tube 14 as the slurry's inertia relative to the accelerating handle 13 provides sufficient force to partially collapse spine 16. The partial collapse of spine 16 allows room for movement of the plurality of particles 26 in fluid 27 of slurry 15. Such movement transfers some of the force of shock 21 over a greater time period than would normally occur without significantly affecting shock 19 which acts in a direction essentially opposite to shock 28 at handle 13, and which is primarily responsible for ball's 18 propulsion. In addition, when the acceleration of handle 13 causes the inside of tube 14 to impact with the plurality of particles 26 in slurry 15, the particles and the fluid transfer of this force is in an essentially random manner since the independent components of the particles careen off one each other and the inner surface of tube 14. This randomization redirects a portion of shock 21 in numerous directions thereby reducing its magnitude in any one direction.

The means and methods herein described for the tennis racket of the present invention may also be installed in any implement subject to torquing shocks, for example, ball bats, golf clubs, carpenter's hammers, and the like.

As variations to the above preferred embodiment, alternative embodiments include securing said tubular member 14 in the shaft portion 35 of the tennis racket, or in the rim around the striking surface 12.

While the above description contains many specificities, they should not be construed as limitations on the scope of the invention but merely as exemplifications of preferred embodiments thereof. It is understood that the present disclosure has been made only by way of example and that numerous changes in the details of construction may be resorted to without departing from the spirit and scope of the invention. Accordingly the scope of the invention should be determined by the appended claims and their legal equivalents, and not by the examples which have been given.

I claim:

1. A tennis racket comprising:

a striking surface, a shaft portion, and a handle portion, a tubular member inserted into said handle portion of said tennis racket, having a first end and a second end, said first end having an opening therein, a hollow spine member secured within said tubular member by a compression nipple, a plurality of particles interiorly disposed within said tubular member, a fluid interiorly situated within said tubular member, and means for sealing said opening in said first end of said tubular member.

2. The tennis racket of claim 1 wherein said tubular member is composed of metal.

3. The tennis racket of claim 1 wherein said hollow spine member is composed of silicone rubber.

4. The tennis racket of claim 1 wherein said hollow spine member is composed of plastic.

5. The tennis racket of claim 1 wherein said plurality of particles are composed of metal.

6. The tennis racket of claim 1 wherein said plurality of particles are composed of plastic.

7. The tennis racket of claim 1 wherein said plurality of particles are freely flowable.

8. The tennis racket of claim 1 wherein said fluid is an oil.

9. The tennis racket of claim 1 wherein said means for sealing said opening in said first end of said tubular member comprises a plug.

10. In a tennis racket made of rigid material and having a striking surface, a shaft portion, and a handle portion, the improvement comprising a tubular member inserted into said handle portion of said tennis racket having a first end and a second end, said first end having an opening therein, an elongated hollow tube spine member secured within said tubular member by a compression nipple and extending through said tubular member, a plurality of particles interiorly disposed within said tubular member, a fluid dispersed within said tubular member and in contact with said plurality of particles, and means for sealing said opening in said first end of said tubular member.

11. The tennis racket of claim 10 wherein said tubular member is a cylinder of plastic.

12. The tennis racket of claim 11 wherein said tubular member is secured within said racket by adhesives.

13. The tennis racket of claim 10 wherein said spine member is composed of silicone rubber.

14. The tennis racket of claim 10 wherein said plurality of particles are composed of metal.

15. The tennis racket of claim 10 wherein said fluid is an oil.

16. The tennis racket of claim 10 wherein said means for sealing said opening in said first end of said tubular member comprises a plug.

* * * * *